United States Patent [19]

Bliss

[11] Patent Number: 4,951,781

[45] Date of Patent: Aug. 28, 1990

[54] SCAFFOLDING STRUCTURE

[76] Inventor: Jeffrey J. Bliss, 110 Silver St., North Granby, Conn. 06060

[21] Appl. No.: 445,279

[22] Filed: Dec. 4, 1989

[51] Int. Cl.[5] ..... E04G 1/34

[52] U.S. Cl. ..... 182/152; 182/155; 182/223; 108/115

[58] Field of Search ..... 182/152, 155, 223, 27; 108/115

[56] References Cited

U.S. PATENT DOCUMENTS

| | | | |
|---|---|---|---|
| 1,763,766 | 6/1930 | Erwin | 182/223 |
| 1,912,947 | 6/1933 | Martin | 182/179 |
| 2,394,221 | 2/1946 | Waltz | 182/152 |
| 2,556,611 | 6/1951 | Borgman | 182/223 |
| 2,593,386 | 4/1952 | Dirks | 182/152 |
| 2,782,075 | 2/1957 | Fagan | 182/152 |
| 3,250,344 | 5/1966 | Romano | 182/152 |
| 4,046,221 | 9/1977 | Edenfield | 182/155 |
| 4,089,522 | 5/1978 | Rock | 108/115 |
| 4,249,636 | 2/1981 | Jackson et al. | 182/152 |
| 4,298,094 | 11/1981 | Strong | 182/155 |
| 4,576,251 | 3/1986 | Matsuura et al. | 182/152 |

*Primary Examiner*—Reinaldo P. Machado
*Attorney, Agent, or Firm*—CTC & Associates

[57] ABSTRACT

Scaffolding structure includes first and second frame members with adjacent connected ends and remote free ends. The connected ends are hingedly connected for relative rotation of the frame members about a hinge axis between a closed position in which the frame members overlap each other and an open position in which the frame members are continuations of each other. A first leg member is mounted on the first frame member adjacent its connected end, a second leg member is mounted on the first frame member adjacent its free end, and a third leg member is mounted on the second frame member adjacent its free end. The leg members are positioned to extend in the same direction from the frame members when the frame members are in the open position and are movable between retracted positions in which they are generally parallel to the frame members and extended positions in which they are generally perpendicular to the frame members. The hinge axis is provided by a hinge pin that is removable, so that the first frame member can be used separately from the second frame member.

13 Claims, 3 Drawing Sheets

SCAFFOLDING STRUCTURE

BACKGROUND OF THE INVENTION

This invention relates to scaffolding structure and more especially to improved lightweight, foldable and easily storable scaffolding structure that is particularly useful in repairing high and wide bodied vehicles.

The inventive scaffolding structure also enhances safety and enables repair personnel to perform their work without having to get on and off the scaffolding structure.

The inventive scaffolding structure also lends itself to sheet rock work and many other uses in the home, and is very versatile in use, and is of simple, durable and inexpensive construction.

A patentability search has revealed the following U.S. Pat. Nos.:

| U.S. Pat. No. | Date | Inventor(s) |
|---|---|---|
| 1,912,947 | June 6, 1933 | Martin |
| 2,593,386 | April 15, 1952 | Dirks |
| 4,046,221 | September 6, 1977 | Edenfield |
| 4,249,636 | February 10, 1981 | Jackson et al. |
| 4,298,094 | November 3, 1981 | Strong |
| 4,576,251 | March 18, 1986 | Matsuura et al. |

These prior art patents disclose a number of scaffolding structures. They also disclose other structures, such as a saddle support (Edenfield) and a collapsible sawhorse (Strong). The prior patents do not disclose, suggest or make obvious the inventive scaffolding structure.

SUMMARY OF THE INVENTION

The inventive scaffolding structure includes first and second frame members with adjacent connected ends and remote free ends. The connected ends are hingedly connected for relative rotation of the frame members about a hinge axis between a closed position in which the frame members overlap each other and an open position in which the frame members are continuations of each other. A first leg member is mounted on the first frame member adjacent its connected end, a second frame member is mounted on the first frame member adjacent its free end, and a third leg member is mounted on the second frame member adjacent its free end. The leg members are positioned to extend in the same direction from the frame members when the frame members are in the open position and are movable between retracted positions in which they are generally parallel to the frame members and extended positions in which they are generally perpendicular to the frame members.

Each frame member is substantially rectangular. The length of each frame member from its connected end to its free end is about 54 inches (137 cm) and the width of each frame member is about 12 inches (30.5 cm).

Each leg member preferably has nonskid rubber cap means for engaging a floor, and each frame member has a resilient member therearound for scratch resistance. The resilient member may be a rubber bumper or may be of suitable foamed material.

The frame members are provided with platforms of nonskid mesh material for standing on and through which paint can pass.

The leg members may be of adjustable length. The minimum length of each leg member may be about 12 inches (30.5 cm) and its maximum length may be about 28 inches (71.1 cm) and the length may be continuously adjustable between those limits. Each leg member is disclosed as having two feet that are spaced apart a distance greater than the width of the frame members. Preferably each foot is self-leveling.

The hinge axis between the first and second frame members is provided by a removable hinge pin whereby the frame members are separable so that the first frame member can be used by itself.

As will be appreciated more clearly from what follows, the inventive scaffolding structure well attains the foregoing objects and advantages among others.

DESCRIPTION OF THE INVENTION

Figure 1:
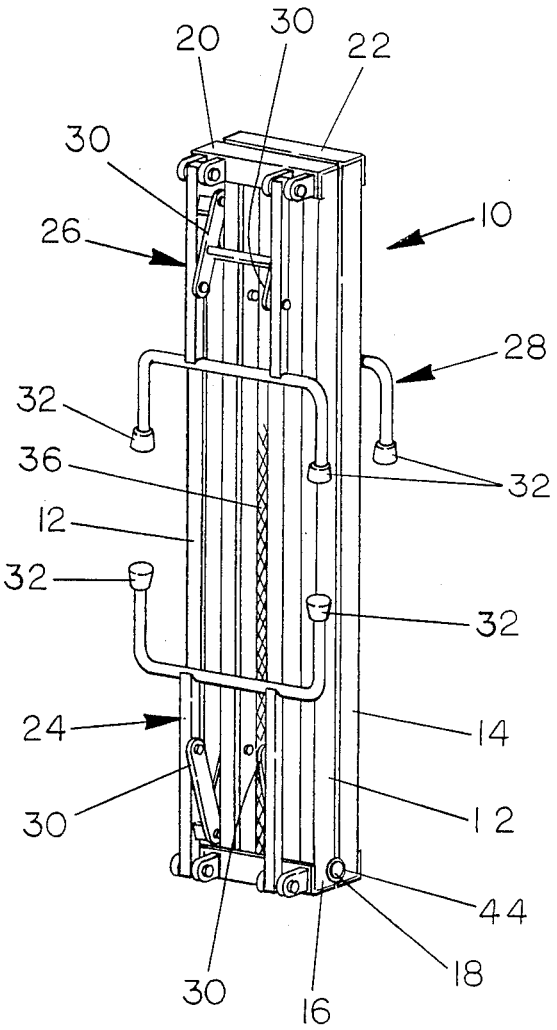
FIG. 1 is a perspective view of preferred scaffolding structure embodying the invention, showing first and second frame members in their relatively closed position and first, second and third leg members in their relatively retracted positions.

FIGS. 1–5 illustrate a preferred scaffolding structure 10 embodying the invention. Scaffolding structure 10 comprises first and second frame members 12 and 14, respectively. Members 12 and 14 have adjacent releasably connected ends 16 and 18, respectively, and remote free ends 20 and 22, respectively. Connected ends 16 and 18 are hingedly connected (as is described more fully hereinafter) for relative rotation of frame members 12 and 14 about a hinge axis between a closed position shown in FIGS. 1, 2, 3 and 5 in which frame members 12 and 14 overlap each other and an open position shown in FIG. 4 in which frame members 12 and 14 are continuations of each other.

Structure 10 also comprises a first leg member 24 mounted on first frame member 12 adjacent its connected end 16, a second leg member 26 mounted on first frame member 12 adjacent its free end 20, and a third leg member 28 mounted on second frame member 14 adjacent its free end 22.

Figure 3:
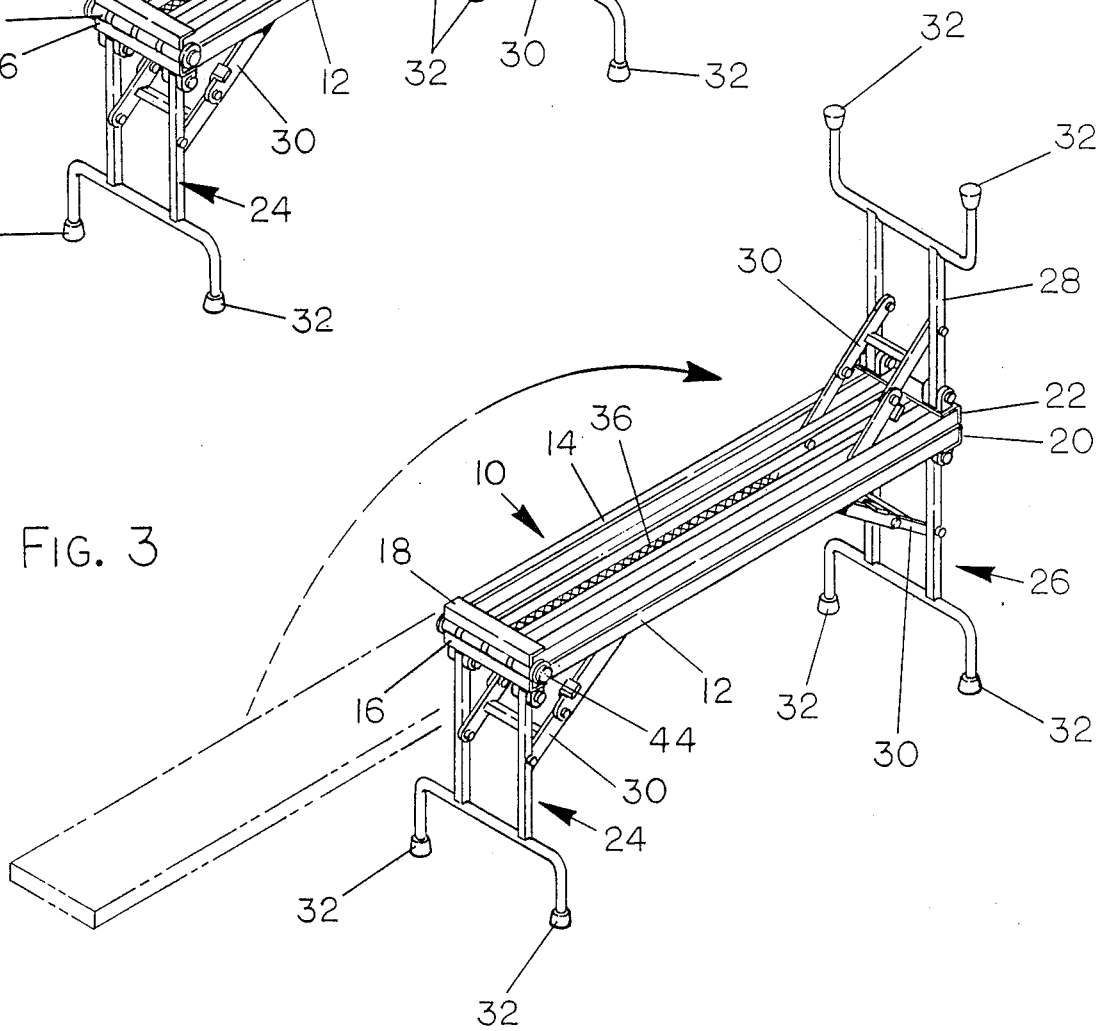
FIG. 3 is a perspective view of the scaffolding structure of FIG. 1 but showing the first and second frame members in their relatively closed position and with the first, second and third leg members in their relatively extended positions.
Figure 4:
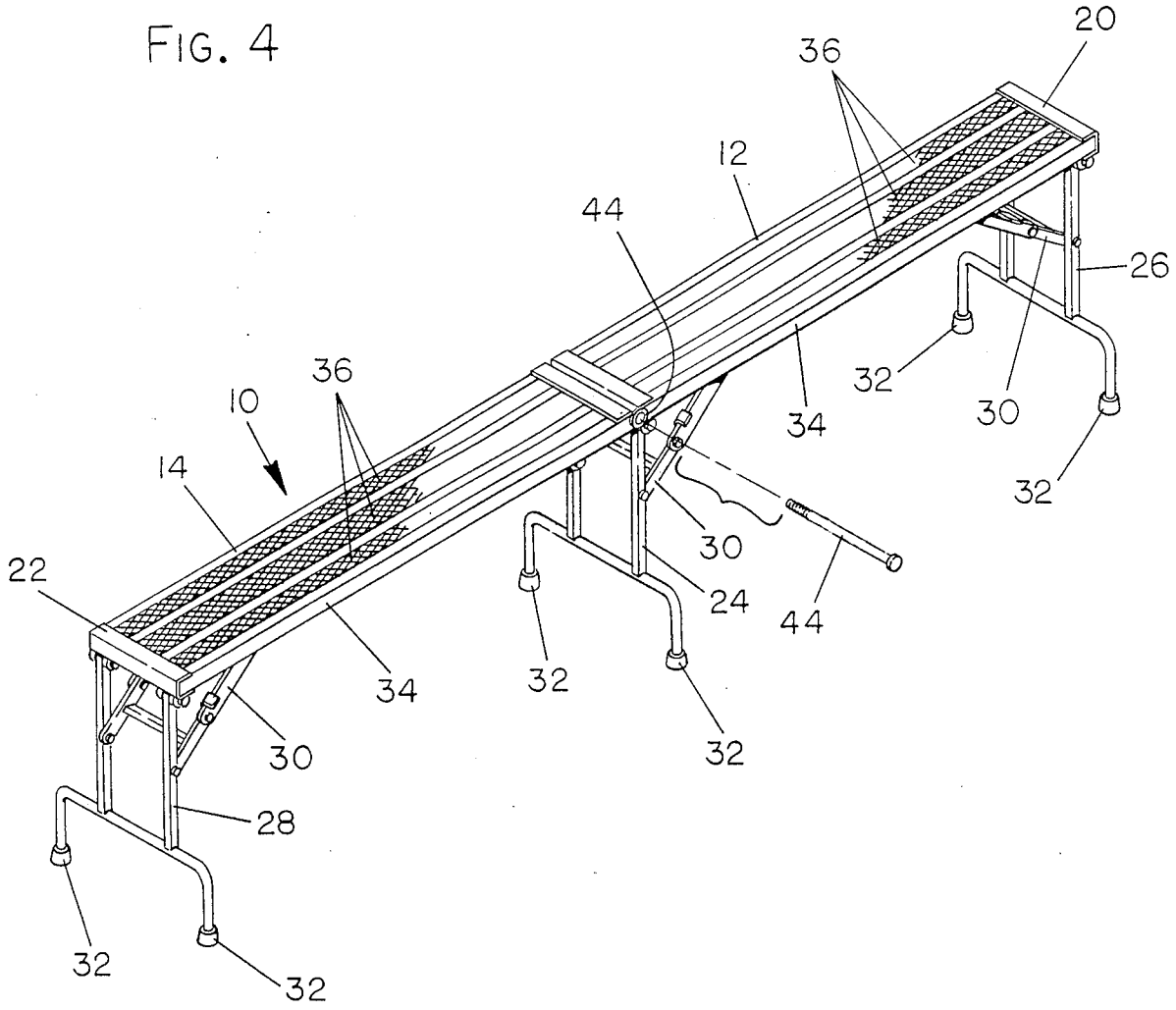
FIG. 4 is a perspective view of the scaffolding structure of FIG. 1, showing the frame members in their relatively open position the leg members in their relatively extended positions.

First, second and third leg members 24, 26 and 28 are positioned to extend in the same direction from frame members 12 and 14 when frame members 12 and 14 are in their open position (FIG. 4). Leg members 24, 26 and 28 are movable between retracted positions in which they are generally parallel to their respective frame members 12 and 14 (FIGS. 1, 2 and 5) and extended positions in which they are generally perpendicular to frame members 12 and 14 (FIGS. 3 and 4). In addition, leg member 28 is shown in phantom in its extended position in FIG. 5. Leg members 24, 26 and 28 are alike and are provided with toggle braces 30 for releasably holding leg members 24, 26 and 28 in their extended positions, in known fashion.

Frame members 12 and 14 are substantially rectangular. The length of each is about 54 inches (137 cm) and its width is about 12 inches (30.5 cm).

Preferably, as indicated in FIG. 4, each frame member 12 and 14 has a resilient member 34 therearound for scratch resistance. Member 34 may be a rubber bumper or foamed material.

Also, frame members 12 and 14 have platforms 36 of nonskid mesh material for standing on and through which spilled paint can pass. Platforms 36 are best seen in FIG. 4.

Leg members 24, 26 and 28 are preferably of continuously adjustable length in known fashion by means not shown between a minimum length of about 12 inches (30.5 cm) and a maximum length of about 28 inches (71.1 cm).

Figure 2:
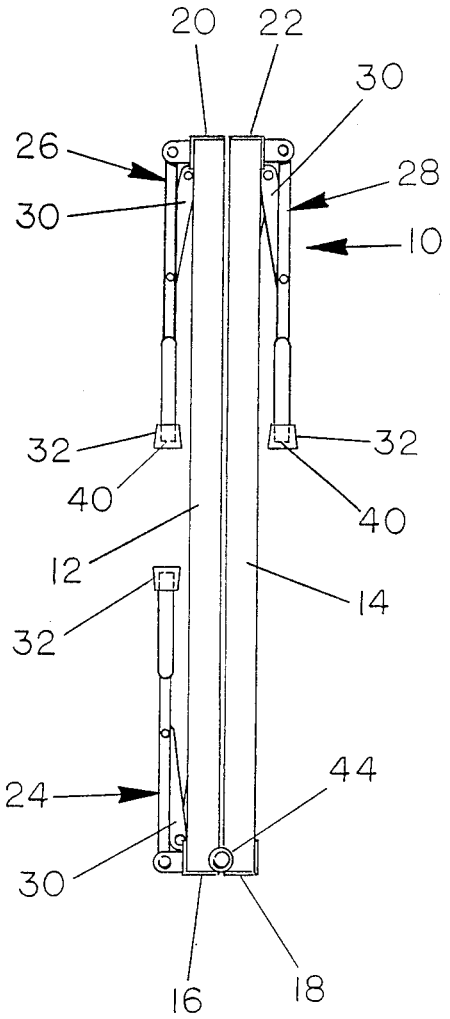
FIG. 2 is an edge view of the preferred scaffolding structure of FIG. 1 but showing the frame members in their relatively closed position and the leg members in their relatively retracted positions.

Furthermore, each leg member 24, 26 and 28 has two feet 40 (two of which are shown in FIG. 2) that are covered by nonskid rubber caps 32. Feet 40 of each leg member are spaced apart a distance greater than the width of frame members 12 and 14.

The hinge axis common to frame members 12 and 14 is provided by a hinge pin 44 that is removable as indicated in FIG. 4, whereby frame members 12 and 14 are separable, so that first frame member 12 with its first leg member 24 and its second leg member 26 can be used separate and apart from second frame member 14 and its third leg member 28, if desired for shorter work.

FIGS. 1 and 2 show scaffolding structure 10 with frame members 12 and 14 in their closed positions and with leg members 24, 26 and 28 in their retracted positions, suitable for storage.

Figure 5:
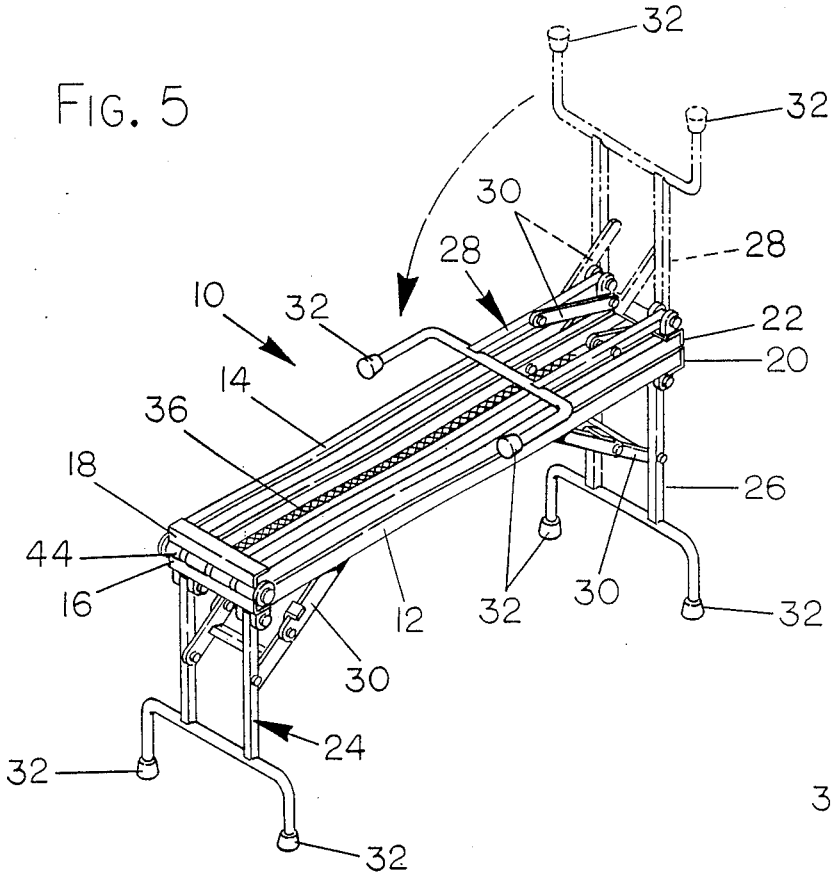
FIG. 5 is a view similar to FIG. 2, differing therefrom in that the third leg member is shown in its retracted position.

FIGS. 3 and 5 show scaffolding structure 10 with frame members 12 and 14 in their closed position, but with leg members 24 and 26 having been moved to their extended positions with their feet 40 (with caps 32 thereon) supporting structure 10. FIG. 5 shows structure 10 with leg member 28 still in its retracted position, but in phantom in its extended position.

FIG. 3 shows scaffolding structure 10 with frame members 12 and 14 in their closed position, with leg members 24, 26 and 28, i.e., all leg members, in their extended positions.

FIG. 4 shows scaffolding structure 10 with second frame member 14 having been pivoted about the hinge axis to move second frame member 14 to its open position relative to first frame member 12, in which frame members 12 and 14 are continuations of each other and feet 40 of third leg member 28 support free end 22 of frame member 14. Scaffolding structure 10 is ready for use.

It is apparent that the invention well attains the stated objects and advantages and others.

The disclosed details are exemplary only and are not to be taken as limitations on the invention except as those details may be included in the appended claims.

What is claimed is

1. Scaffolding structure comprising first and second frame members having adjacent connected ends and remote free ends, said connected ends being hingedly connected for relative rotation of said frame members about a hinge axis between a closed position in which said frame members overlap each other and an open position in which said frame members are continuations of each other, a first leg member mounted on said first frame member adjacent its said connected end, a second leg member mounted on said first frame member adjacent its said free end, and a third leg member mounted on said second frame member adjacent its said free end.

2. Scaffolding structure according to claim 1 wherein said first, second and third leg members are positioned to extend in the same direction from said frame members when said frame members are in said open position.

3. Scaffolding structure according to claim 2 wherein said leg members are movable between retracted positions in which they are generally parallel to said frame members and extended positions in which they are generally perpendicular to said frame members.

4. Scaffolding structure according to claim 3 wherein each said frame member is substantially rectangular.

5. Scaffolding structure according to claim 4 wherein the length of each said frame member from its said connected end to its said free end is about 54 inches (137 cm) and the width of each said frame member is about 12 inches (30.5 cm).

6. Scaffolding structure according to claim 4 wherein each said leg member has a nonskid rubber cap for engaging a floor.

7. Scaffolding structure according to claim 4 wherein each said frame member has a resilient member therearound for scratch resistance.

8. Scaffolding structure according to claim 7 wherein said resilient member is a rubber bumper.

9. Scaffolding structure according to claim 7 wherein said resilient member is foamed material.

10. Scaffolding structure according to claim 4 wherein each said frame member has a platform of nonskid mesh material for standing on and through which spilled paint can pass.

11. Scaffolding structure according to claim 3 wherein each said leg member has two spaced apart feet.

12. Scaffolding structure according to claim 11 wherein said feet of each said leg member are spaced apart a distance greater than the width of said frame member.

13. Scaffolding structure according to claim 1 wherein said hinge axis is provided by a removable hinge pin whereby said frame members are separable so that said first frame member can be used by itself.

* * * * *